US006374497B1

(12) United States Patent
Sun

(10) Patent No.: US 6,374,497 B1
(45) Date of Patent: Apr. 23, 2002

(54) UTILITY CUTTER

(75) Inventor: Fu-Cheng Sun, Taipei Hsien (TW)

(73) Assignee: Taiwan San Tyau Co., Ltd., Taipei Hsien (TW)

( * ) Notice: Subject to any disclaimer, the term of this patent is extended or adjusted under 35 U.S.C. 154(b) by 0 days.

(21) Appl. No.: 09/900,019

(22) Filed: Jul. 9, 2001

(51) Int. Cl.[7] ..... B26B 1/08
(52) U.S. Cl. ..... 30/162; 30/125; 30/335
(58) Field of Search ..... 30/125, 162, 335

(56) References Cited

U.S. PATENT DOCUMENTS 3,879,847 A * 4/1975 Roll ..... 30/162
5,644,843 A * 7/1997 Young ..... 30/162
5,909,930 A * 6/1999 Ragland, III et al. ..... 10/125
6,324,763 B1 * 12/2001 Lee ..... 30/162
6,330,749 B1 * 12/2001 Khachatoorian et al. ..... 30/162

* cited by examiner

*Primary Examiner*—Hwei-Siu Payer
(74) *Attorney, Agent, or Firm*—Bacon & Thomas, PLLC

(57) ABSTRACT

A utility cutter includes right and left covers that are screwed together to receive a blade braking gear and a spare blade cartridge therein. The blade braking gear includes a blade holder for holding a blade thereto, and a slide button and a blade-replacing key movably connected to the blade holder. When the slide button is depressed and slid forward, the blade-replacing key and the blade holder are moved forward to extend the blade; when the slide button is depressed and slid backward, the blade is retracted into the covers; and when the blade-replacing key is depressed when the blade is extended, the blade could be removed from the cutter and replaced with a new one. The spare blade cartridge stores multiple spare blades therein. By pushing a front cover of the cartridge forward, a spare blade is pushed out of the cartridge for replacing an old blade.

1 Claim, 12 Drawing Sheets

UTILITY CUTTER

FIELD OF THE INVENTION

The present invention relates to a utility cutter, and more particularly to a utility cutter that includes a blade braking gear and a spare blade cartridge to enable stable holding of the cutter and convenient and safe extending, retracting, and replacing of a blade thereof.

BACKGROUND OF THE INVENTION

A conventional utility cutter usually includes a blade extending/retracting gear. A braking spring plate in the blade extending/retracting gear frictionally contacts with a wave-shaped stopping slot provided at one side of the cutter. Such frictional contact causes wearing of the spring plate and the stopping slot to reduce the braking function of the blade extending/retracting gear, and a blade mounted on the cutter tends to unexpectedly and dangerously slide out of the cutter to injure a user. Moreover, it is a common practice to separately store spare blades for the utility cutter. A user has to take time to locate the spare blades and replace the old blade.

It is therefore tried by the inventor to develop a utility cutter that has an improved blade braking gear and a spare blade cartridge associated with the cutter to eliminate drawbacks existing in the conventional utility cutters.

SUMMARY OF THE INVENTION

A primary object of the present invention is to provide a utility cutter that includes a blade braking gear to enable stable and smooth operation of extending, retracting and replacing a blade of the cutter.

Another object of the present invention is to provide a utility cutter that includes a spare blade cartridge associated with the cutter to enable convenient supply of spare blades.

To achieve the above and other objects, the utility cutter of the present invention mainly includes right and left covers that are screwed together to receive a blade braking gear and a spare blade cartridge therein. The blade braking gear includes a blade holder for holding a blade thereto, and a slide button and a blade-replacing key movably connected to the blade holder. When the slide button is depressed and slid forward, the blade-replacing key and the blade holder are moved forward to extend the blade; when the slide button is depressed and slid backward, the blade is retracted into the covers; and when the blade-replacing key is depressed when the blade is extended, the blade could be removed from the cutter and replaced with a new one. The spare blade cartridge stores multiple spare blades therein. By pushing a front cover of the cartridge forward, a spare blade is pushed out of the cartridge for replacing an old blade.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
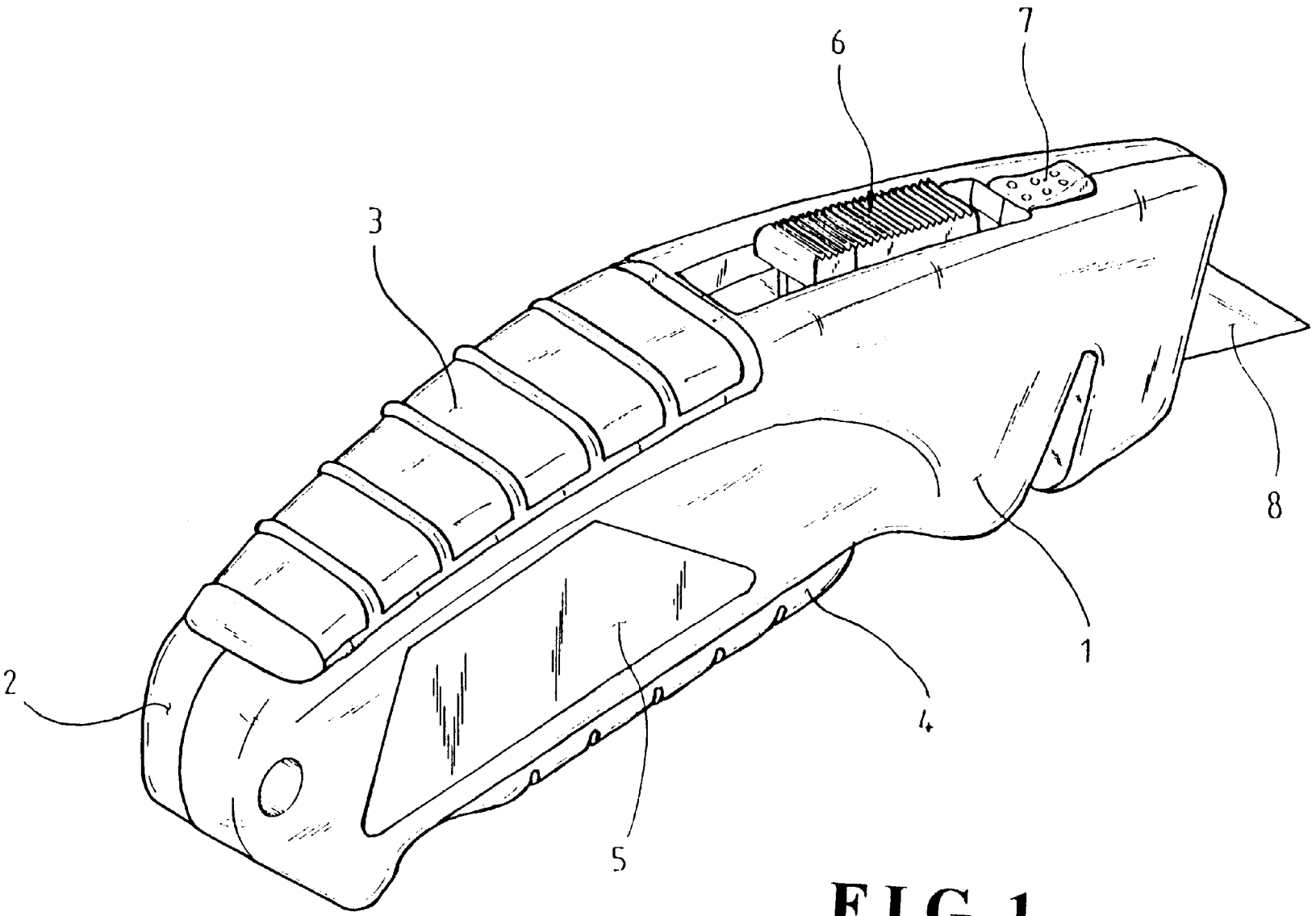
FIG. 1 is an assembled perspective view of a utility cutter according to the present invention.
Figures 2, 3, 4:
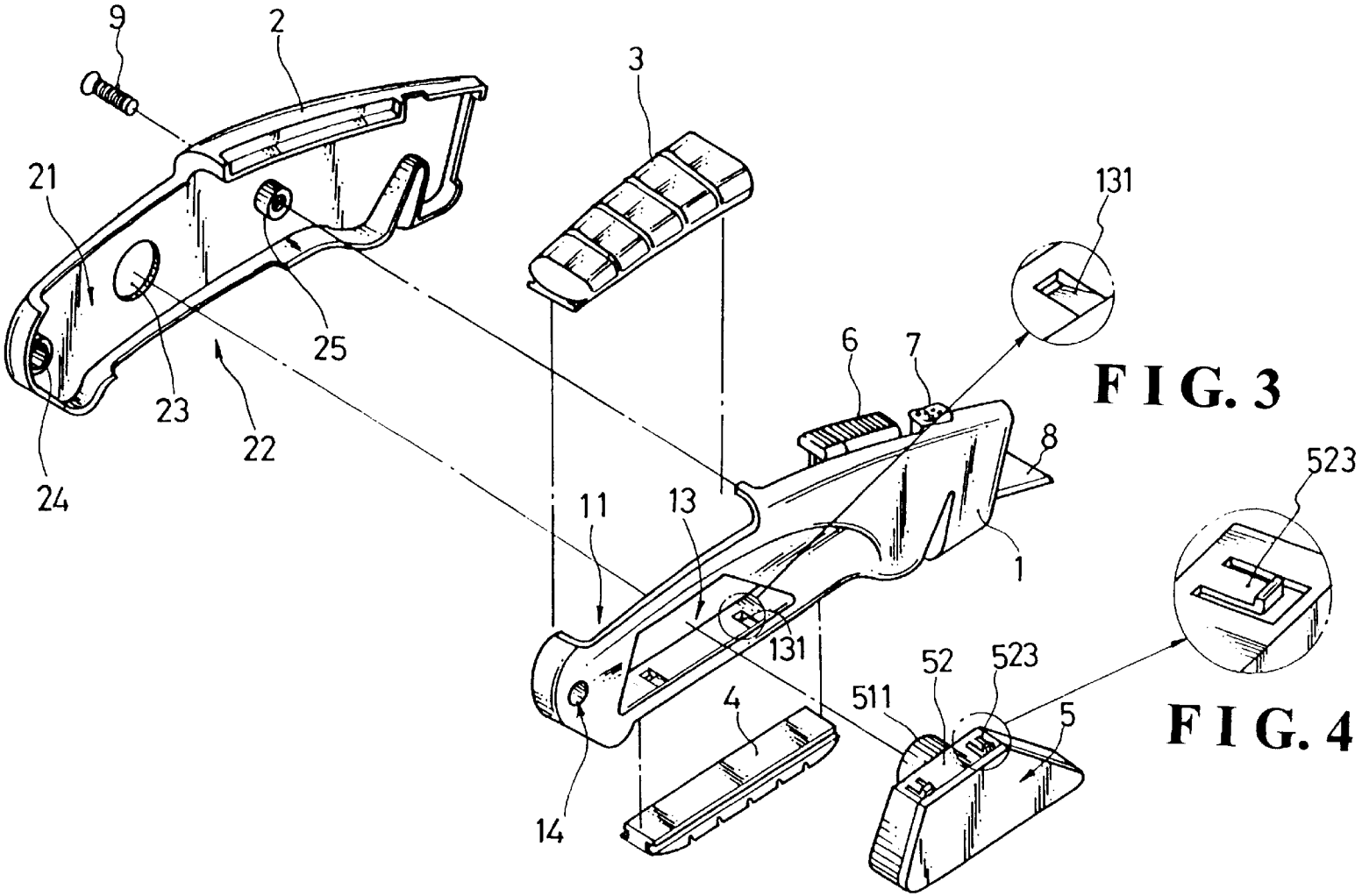
FIG. 2 is an exploded perspective view of FIG. 1.
FIG. 3 is a fragmentary and enlarged view of FIG. 2 showing a catch provided in the trapezoidal opening on the right cover of the utility cutter.
FIG. 4 is a fragmentary and enlarged view of FIG. 2 showing a hook provided on the spare blade cartridge.

Please refer to FIGS. 1 and 2 in which a utility cutter according to the present invention is shown. The utility cutter mainly includes a right cover 1, a left cover 2, a top pad 3, a bottom pad 4, a spare blade cartridge 5, and a blade braking gear 6.

Figure 11:
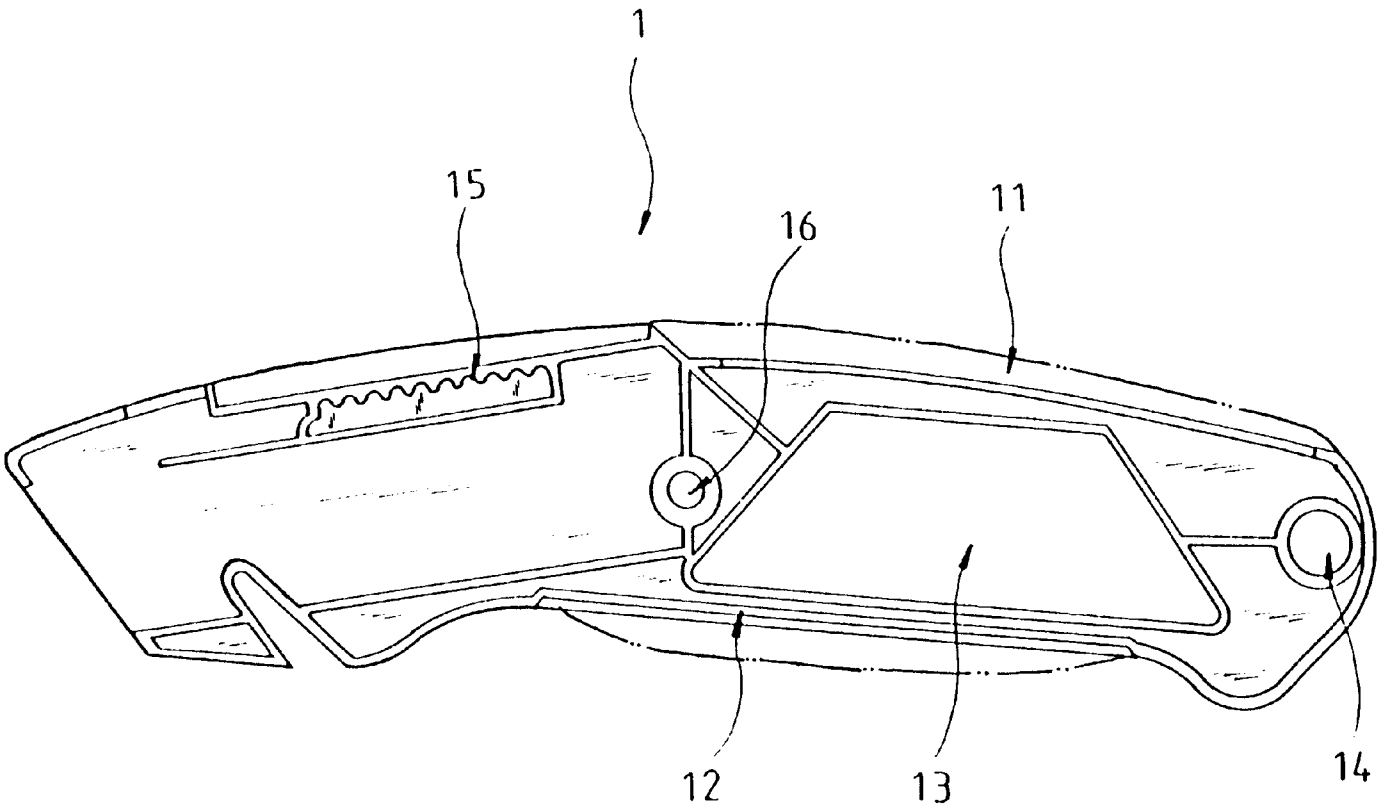
FIG. 11 is a plan view of the right cover of the utility cutter of the present invention, showing an inner structure thereof.

Please also refer to FIG. 11. The right cover 1 is an integrally formed shell having a top right long slot 11 provided at a rear upper part thereof and a bottom right long slot 12 provided at a rear lower part thereof. The right cover 1 is also provided at a rear wall portion with a trapezoidal opening 13, at a rear end with a round through hole 14, at an inner side of a top front part with a horizontally extended long stopping cavity 15 having a wave-shaped upper inner edge, and at an inner central point with a screw hole 16.

The left cover 2 is also an integrally formed shell having a top left long slot 21 provided at a rear upper part thereof and a bottom left long slot 22 provided at a rear lower part thereof. The left cover 2 is also provided at a rear part with a round hole 23, at a rear end with a round through hole 24 corresponding to the round through hole 14 on the right cover 1, and at a central point with a screw hole 25 corresponding to the screw hole 16 of the right cover 1.

The top and the bottom pads 3 and 4 are integrally formed from a soft plastic material to enable comfortable and stable holding of the utility cutter at the top and the bottom pads 3, 4.

Please refer to FIGS. 2, 3, 4, 13, 14 and 15 at the same time. The spare blade cartridge 5 mainly includes a front cover 51, a cartridge frame 52, and a back cover 53.

The front cover 51 of the spare blade cartridge 5 includes a knob 511 protruded from an outer center thereof, a curved open slot 512 formed at a rear end thereof, and a push projection 513 formed at an inner center thereof.

The cartridge frame 52 is a hollow frame defining a trapezoidal space 521 for receiving a plurality of spare blades therein. One side of the cartridge frame 52 adjacent to the front cover 51 is provided with upper and lower rails 522, between which the front cover 51 is slidably mounted. The cartridge frame 52 is provided at upper and lower surfaces with symmetrical hooks 523 (see FIG. 4) having a certain degree of elasticity for engaging with catches 131 provided in the trapezoidal opening 13 on the right cover 1, so that the spare blade cartridge 5 could be quickly and smoothly set in the trapezoidal opening 13 without the risk of easily separating from the right cover 1.

The back cover 53 is connected to a base edge 524 of the cartridge frame 52 to form an integral part of the cartridge frame 52. The base edge 524 provides high toughness and therefore allows the back cover 53 to be repeatedly turned about the base edge 524 relative to the cartridge frame 52 between a closed and an opened position. The back cover 53 is provided at a position of the inner surface opposite to the base edge 524 with a fastening means 531 for firmly holding the back cover 53 to the rear side of the cartridge frame 52 when the back cover 53 is in the closed position.

The spare blades are loaded into the cartridge frame 52 via the rear side thereof. After the spare blades are loaded, a feed spring plate 54 connected to an inner side of the back cover 53 elastically presses the spare blades against an inner surface of the front cover 51. The feed spring plate 54 includes an arched middle portion and two outer ends that are extended through two symmetrical holders 532 provided at an inner central area of the back cover 53 to firmly hold the feed spring plate 54 to the back cover 53.

Figure 14:
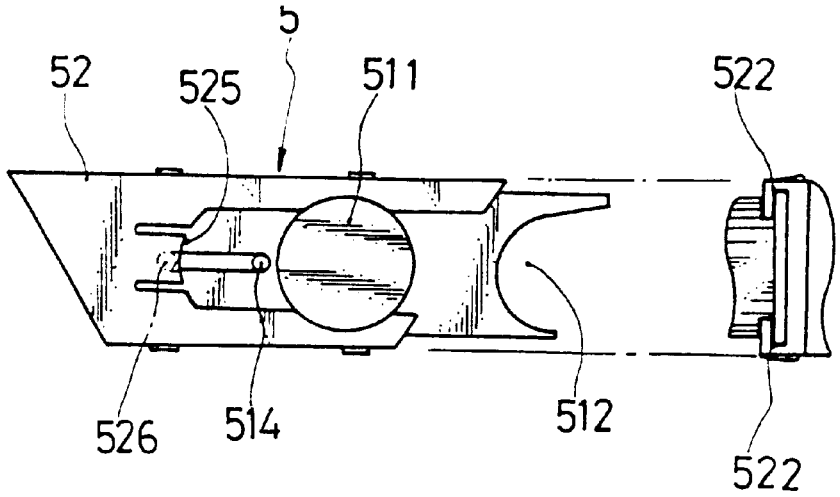
FIG. 14 shows front plan view and end view of the spare blade cartridge of FIG. 13.
Figure 15:
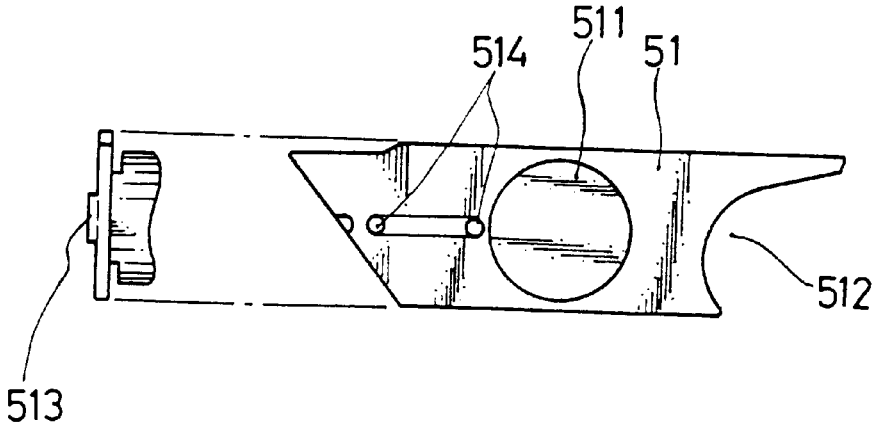
FIG. 15 shows front plan view and end view of the front cover of the spare blade cartridge of FIG. 13.

As shown in FIGS. 14 and 15, the front cover 51 of the spare blade cartridge 5 is slidably mounted in the rails 522 to movable between a home position and an extended position. When the front cover 51 is pushed forward from the home position, the push projection 513 at the inner center of the front cover 51 is in contact with and pushes out a spare blade in the cartridge frame 52. A distance by which the front cover 51 could be pushed forward from the home position to the extended position is defined by a front and a rear locating hole 514 provided at an outer surface of the front cover 51 and a locating dot 526 provided at an inner surface of the cartridge frame 52 near a rear end of an opening 525. When the front cover 51 is at the home position without being pushed forward, the locating dot 526 engages with the front locating hole 514 to prevent the front cover 51 from moving. When the front cover 51 is pushed forward along the rails 522, the locating dot 526 is finally shifted into the rear locating hole 514 and prevents the front cover 51 from completely separating from the cartridge frame 52.

The back cover 53 of the spare blade cartridge 5 is provided at an inner surface with the spring plate 54 that elastically pushes the plurality of spare blades in the cartridge frame 52 against the front cover 51. When a user applies a force on the knob 511 of the front cover 51 to push the latter forward, the push projection 513 is in contact with and pushes out a spare blade in the cartridge frame 52 closest to the front cover 51, so that the spare blade is exposed from the front curved open slot 512 and could be pulled out for use.

Figure 12:
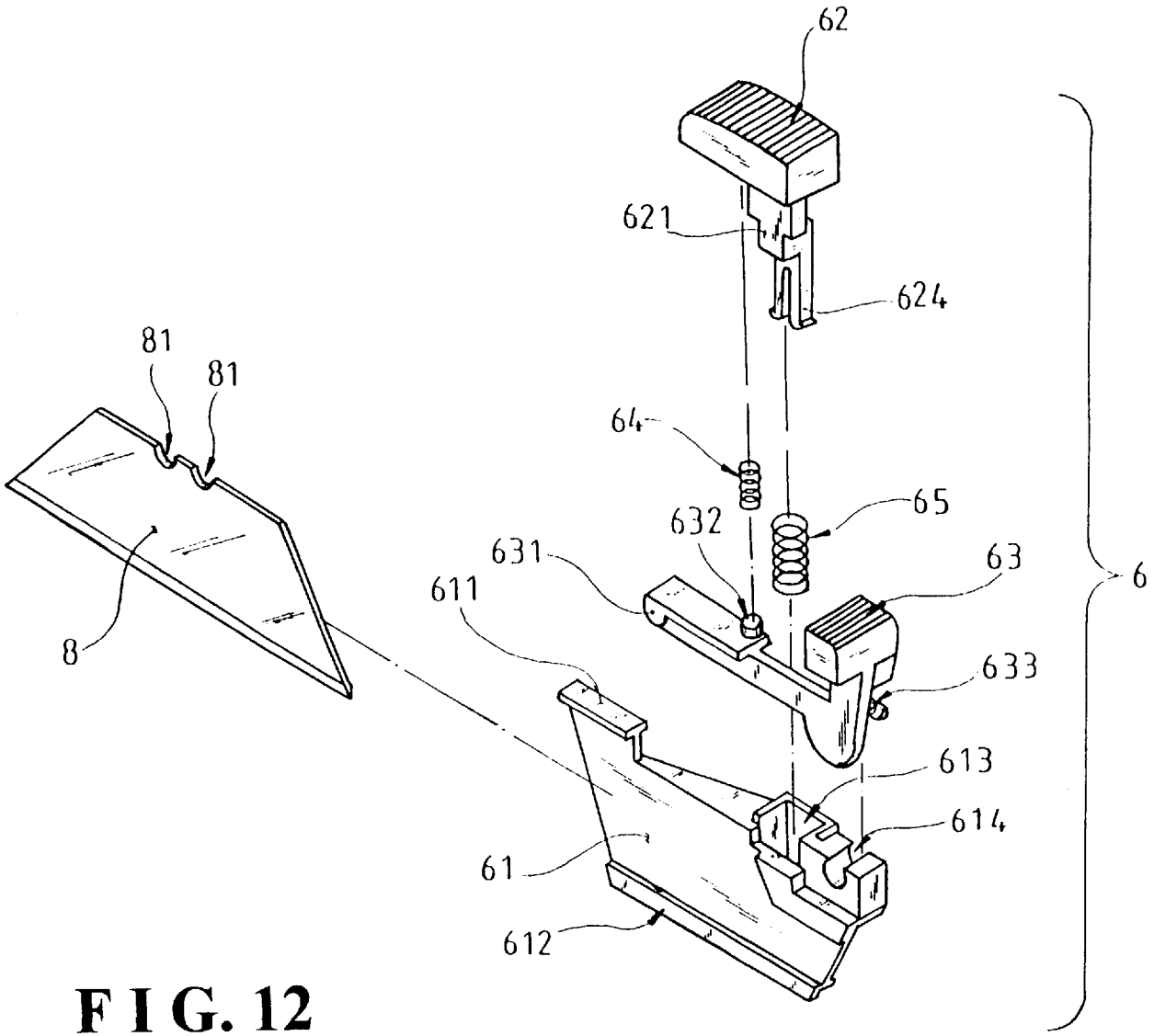
FIG. 12 is an exploded perspective view of the blade braking gear of the present invention.
Figure 13:
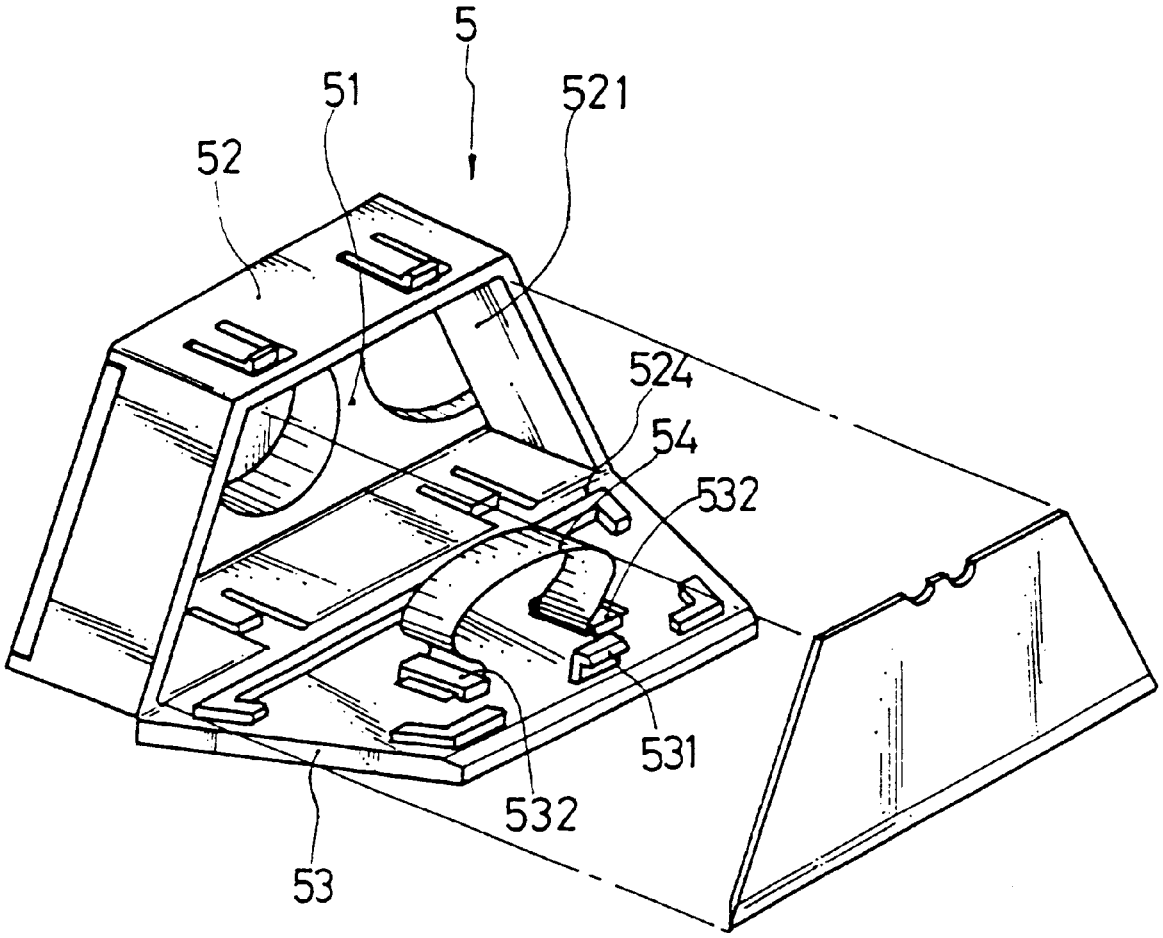
FIG. 13 is a perspective view of the spare blade cartridge of the present invention with a back cover thereof at an opened position.

Please refer to FIG. 12 that is an exploded perspective view of the blade braking gear 6. The blade braking gear 6 mainly includes a blade holder 61, a slide button 62, and a blade-replacing key 63.

Figure 5:
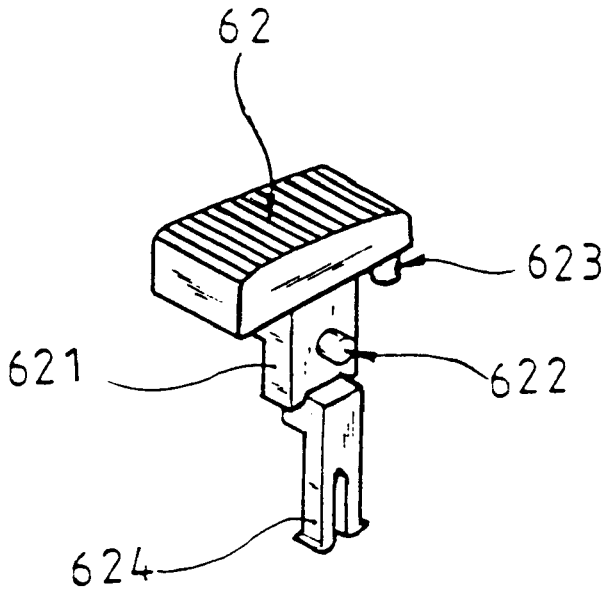
FIGS. 5 and 6 are rear right and rear left perspective views, respectively, of a slide button included in the blade braking gear of the present invention.
Figure 6:
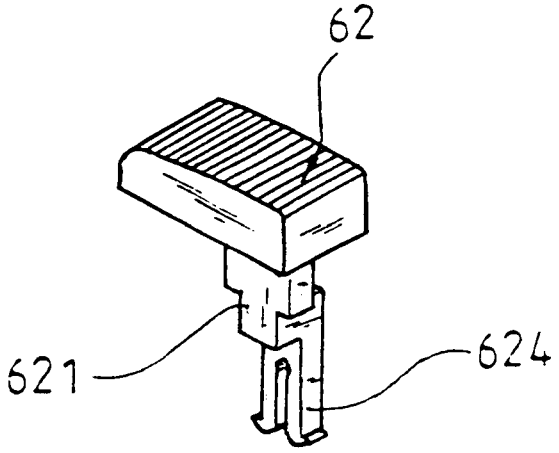

Please refer to FIGS. 5 and 6 that are rear right and rear left perspective views, respectively, of the slide button 62. The slide button 62 has a downward extended main body 621, a control stud 622 projected from a center at a right side of the main body 621, a front stud 623 downward projected from a lower front of the main body 621, and a pair of hooked legs 624 downward extended from a lower end of the main body 621.

Figure 7:
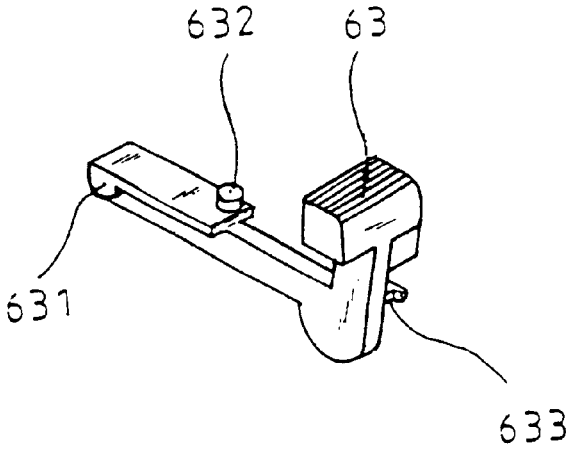
FIGS. 7 and 8 are rear left and rear right perspective views, respectively, of a blade-replacing key included in the blade braking gear of the present invention.
Figure 8:
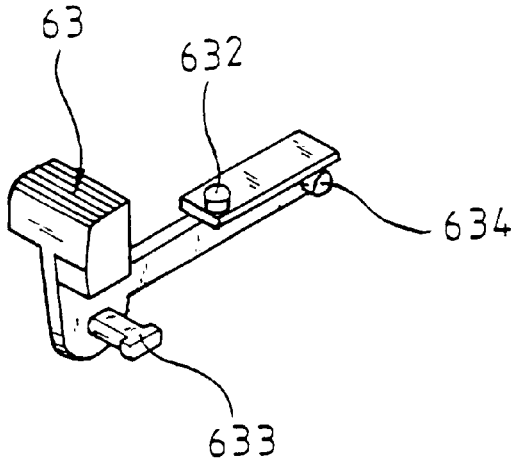

Please refer to FIGS. 7 and 8 that are rear left and rear right perspective views, respectively, of the blade-replacing key 63. The blade-replacing key 63 is a horizontally extended member and is provided at a left side of a lower front with a semicircular projection 631, at a middle point with an upward projected middle stud 632, at a right side of a rear end with a supporting shaft 633, and at a right side of the lower front with a right stud 634.

Figure 9:
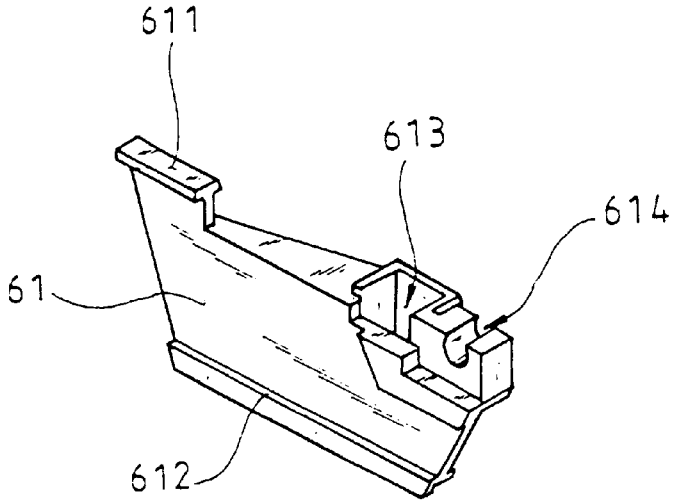
FIGS. 9 and 10 are rear left and rear right perspective views, respectively, of a blade holder included in the blade braking gear of the present invention.
Figure 10:
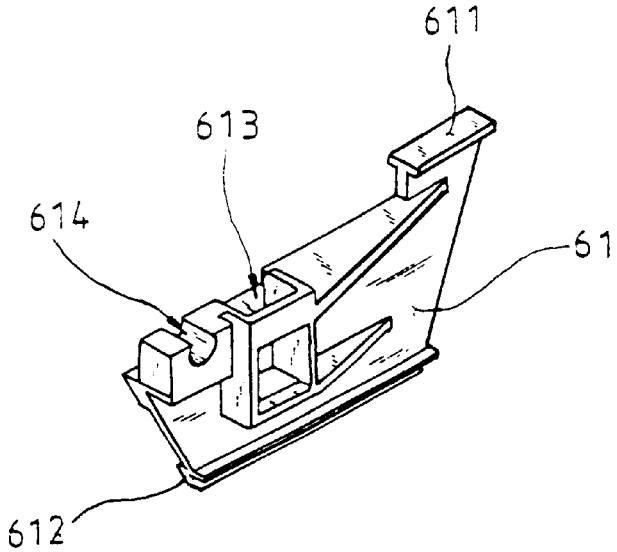

Please refer to FIGS. 9 and 10 that are rear left and rear right perspective views, respectively, of the blade holder 61. The blade holder 61 includes a T-shaped upper engaging plate 611 provided at an upper front end thereof, a lower engaging plate 612 provided at a lower end thereof, a vertically extended rectangular slot 613 provided near a middle portion thereof, and a semicircular shaft slot 614 provided near an upper rear end thereof.

Please now refer to FIG. 12 again. In the blade braking gear 6, the supporting shaft 633 of the blade-replacing key 63 is seated in the semicircular shaft slot 614 of the blade holder 61; the front stud 623 of the slide button 62 is vertically aligned with the middle stud 632 of the blade-replacing key 63 with a first coil spring 64 put between them to generally connect them to each other; and the pair of hooked legs 624 of the slide button 62 have a second coil spring 65 put around them and are downward extended into the rectangular slot 613 of the blade holder 61 to fixedly locate therein. A blade 8 having semicircular recesses 81 spaced along an upper edge thereof is movably mounted on one side of the blade holder 61 between the upper and the lower engaging plates 611, 612, such that the semicircular projection 631 of the blade-replacing key 63 selectively engages with one of the semicircular recesses 81 on the blade 8.

To assemble a complete utility cutter of the present invention, the blade braking gear 6 is mounted between the right and the left cover 1, 2 by engaging the rightward projected control stud 622 of the slide button 62 with the wave-shaped upper edge of the stopping cavity 15 on the inner surface of the right cover 1; a thrust button 7 is provided at an upper front of the right cover 1 to locate in front of the blade braking gear 6; the top pad 3 is set in the top right long slot 11 and the bottom pad 4 is set in the bottom right long slot 12; the left cover 2 is closed to the left side of the right cover 1 and fastened thereto by threading a screw 9 through the screw hole 25 on the left cover 2 and the screw hole 16 on the inner side of the right cover 1; and the spare blade cartridge 5 is fitted in the trapezoidal opening 13 on the right cover 1 with the hooks 523 on the cartridge 5 engaged with the catches 131 on the right cover 1.

Figure 16:
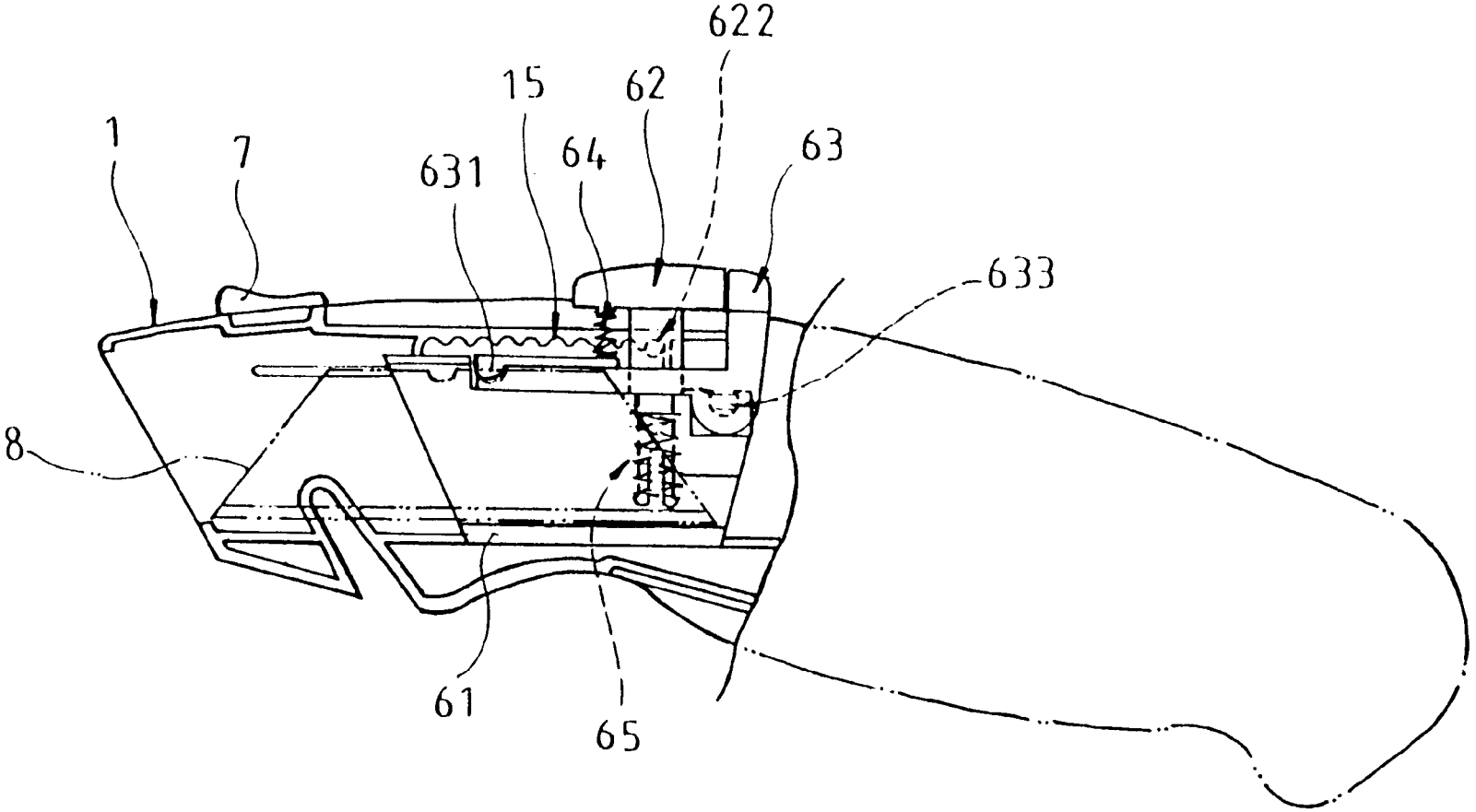
FIGS. 16 and 17 are left side plan views of the utility cutter of the present invention, a front part of the left cover being cut away to show operations of extending and retracting a blade, respectively.

FIG. 16 shows the manner of extending a blade on the utility cutter of the present invention. When the blade 8 is in a standby position inside the right and the left covers 1, 2 and ready for extending, the control stud 622 of the slide button 62 is sideward extended into the stopping cavity 15 to engage with a rear end of the wave-shaped upper edge of the stopping cavity 15. When the slide button 62 is depressed, the control stud 622 is moved downward to disengage from the wave-shaped upper edge of the stopping cavity 15, allowing the slide button 62 to be slid forward. At this point, the blade holder 61, the blade-replacing key 63, and the blade 8 on the blade holder 61 are brought by the slide button 62 to move forward at the same time. When the blade 8 is moved to expose from a front end of the utility cutter by a suitable length, the slide button 62 is released, and a spring force of the first and the second coil springs 64, 65 would push the slide button 62 upward to engage the control stud 622 with a front end of the wave-shaped upper edge of the stopping cavity 15.

Figure 17:
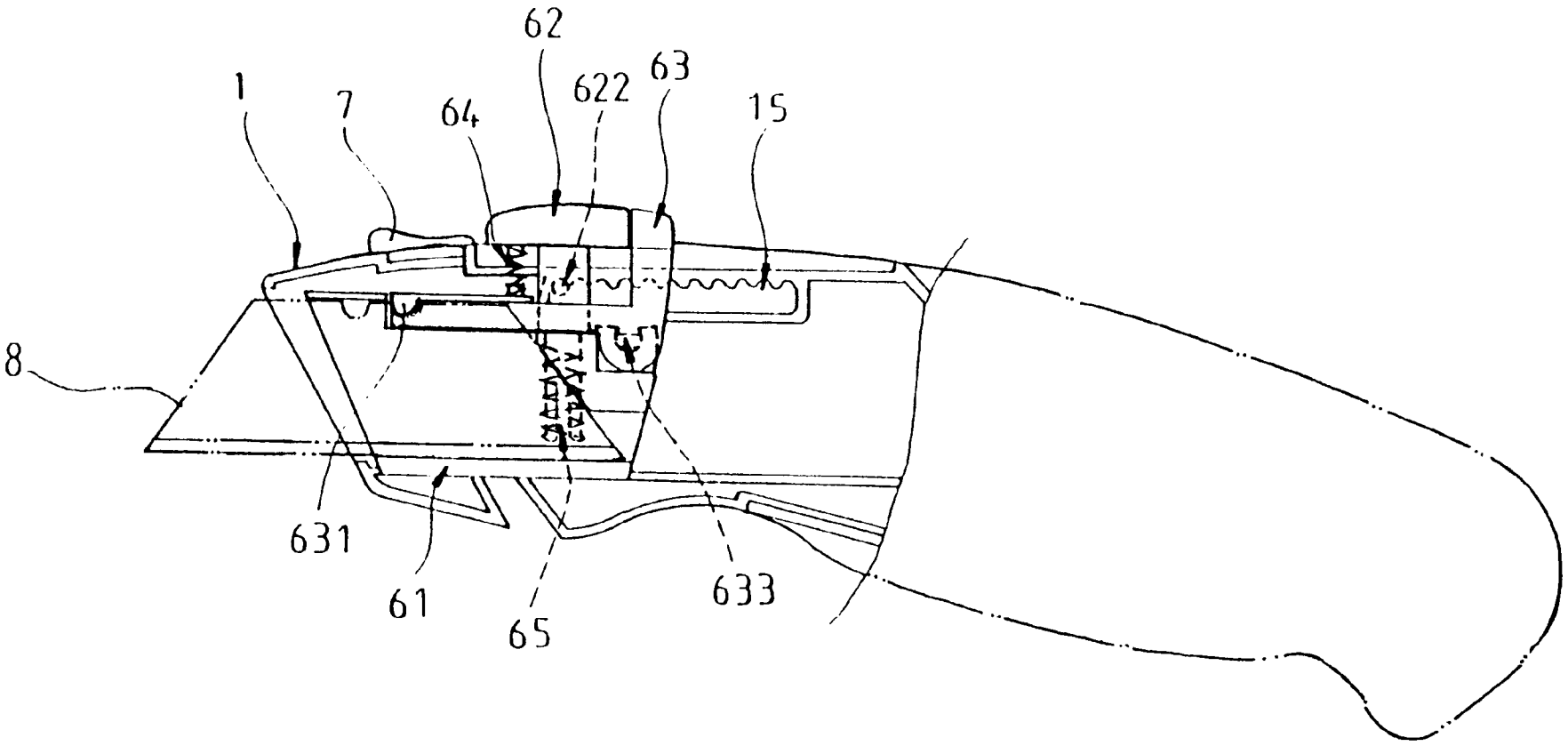

FIG. 17 shows the manner of retracting a blade 8 on the utility cutter of the present invention. When the blade 8 is at an extended position, the control stud 622 of the slide button 62 is engaged with the front end of the wave-shaped upper edge of the stopping cavity 15. A user needs only to depress and slide the slide button 62 backward, and release the slide button 62 when the blade 8 has been retracted into the covers 1 and 2.

Figure 18:
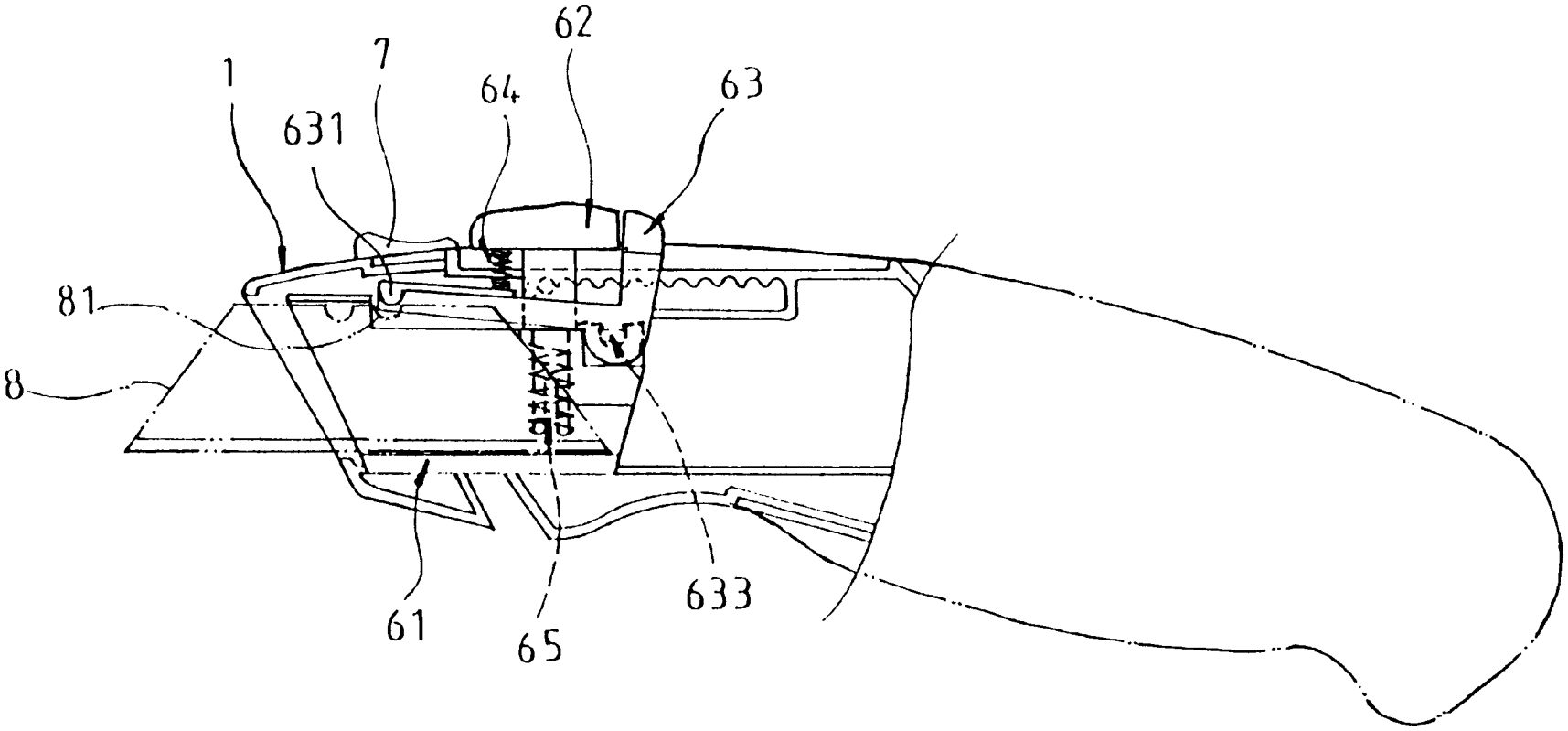
FIG. 18 is a left side plan view of the utility cutter of the present invention, a front part of the left cover being cut away to show the operation of replacing the blade.

FIG. 18 shows the manner of replacing the blade 8. To replace an old blade 8, a user first extends the blade 8 in the above-described manner, and then depresses the blade-replacing key 63. The blade-replacing key 63 would pivotally turn about the supporting shaft 633 seated in the shaft slot 614 on the blade holder 61, causing the semicircular projection 631 at the front end of the blade-replacing key 63 to move upward and disengage from the semicircular recess 81 on the blade 8. At this point, the old blade 8 could be removed from the blade holder 61 and replaced with a spare blade. Thereafter, the blade-replacing key 63 is released, and the semicircular projection 631 is pushed downward by the first coil spring 64 to automatically engage into the recess 81 of the new blade 8.

What is claimed is:

1. A utility cutter, comprising a right cover, a left cover, a top pad, a bottom pad, a spare blade cartridge, and a blade braking gear;

said right cover being an integrally formed shell having a top right long slot provided at a rear upper part thereof and a bottom right long slot provided at a rear lower part thereof; said right cover being provided at a rear wall portion with a trapezoidal opening, at a rear end with a round through hole, at an inner side of a top front part with a horizontally extended long stopping cavity having a wave-shaped upper inner edge, and at an inner central point with a screw hole;

said left cover being an integrally formed shell having a top left long slot provided at a rear upper part thereof and a bottom left long slot provided at a rear lower part thereof; said left cover being provided at a rear part with a round hole, at a rear end with a round through hole corresponding to said round through hole on said right cover, and at a central point with a screw hole corresponding to said screw hole of said right cover;

said top pad being integrally formed from a soft plastic material;

said bottom pad being integrally formed from a soft plastic material;

said spare blade cartridge comprising a front cover, a cartridge frame, and a back cover;

said front cover of said spare blade cartridge including a knob protruded from an outer center thereof, a curved open slot formed at a rear end thereof, and a push projection formed at an inner center thereof;

said cartridge frame being a hollow frame defining a trapezoidal space for receiving a plurality of spare blades therein, one side of said cartridge frame adjacent to said front cover being provided with upper and lower rails, between which said front cover is slidably mounted; said cartridge frame being provided at upper and lower surfaces with symmetrical hooks having a certain degree of elasticity for engaging with catches provided in said trapezoidal opening on said right cover;

said back cover being connected to a base edge of said cartridge frame to form an integral part of said cartridge frame, said back cover being provided at a predetermined position with a fastening means for firmly holding said back cover to a rear side of said cartridge frame;

a feed spring plate being connected to an inner side of said back cover to elastically press said spare blades against an inner surface of said front cover, said feed spring plate including an arched middle portion and two outer ends that are extended through two symmetrical holders provided at an inner central area of said back cover; and said front cover being slidably mounted in said rails of said cartridge frame and being provided at an outer surface with a front locating hole and a rear locating hole, into which a locating dot provided at an inner surface of said cartridge frame near a rear end of an opening thereof is selectively engaged to define a range within which said front cover is slidable relative to said cartridge frame; and said blade braking gear comprising a blade holder, a slide button, and a blade-replacing key;

said slide button having a downward extended main body, a control stud projected from a center at a right side of said main body, a front stud downward projected from a lower front of said main body, and a pair of hooked legs downward extended from a lower end of said main body;

said blade-replacing key being a horizontally extended member and being provided at a left side of a lower front with a semicircular projection, at a middle point with an upward projected middle stud, at a right side of a rear end with a supporting shaft, and at a right side of the lower front with a right stud;

said blade holder including a T-shaped upper engaging plate provided at an upper front end thereof, a lower engaging plate provided at a lower end thereof, a vertically extended rectangular slot provided near a middle portion thereof, and a semicircular shaft slot provided near an upper rear end thereof; and said supporting shaft of said blade-replacing key being seated in said semicircular shaft slot of said blade holder; said front stud of said slide button being vertically aligned with said middle stud of said blade-replacing key with a first coil spring put between them to generally connect them to each other; said pair of hooked legs of said slide button having a second coil spring put around them and being downward extended into said rectangular slot of said blade holder to fixedly locate therein; and a blade having semicircular recesses spaced along an upper edge thereof being movably mounted on one side of the blade holder between said upper and said lower engaging plates, such that said semicircular projection of said blade-replacing key selectively engages with one of said semicircular recesses on the blade;

whereby by mounting said blade braking gear between said right cover and said left cover with said rightward projected control stud of said slide button engaged with said wave-shaped upper edge of said stopping cavity on the inner side of said right cover, mounting a thrust button at an upper front of said right cover in front of said slide button, setting said top pad in said top right long slot and said bottom pad in said bottom right long slot, screwing said left cover to a left side of said right cover by threading a screw through said screw hole on said left cover and said screw hole on the inner side of said right cover, and fitting said spare blade cartridge in said trapezoidal opening on said right cover, said utility cutter is ready for use.

* * * * *